United States Patent [19]

Maruyama et al.

[11] Patent Number: 4,797,339

[45] Date of Patent: Jan. 10, 1989

[54] TONER FOR DEVELOPING ELECTROSTATIC IMAGES

[75] Inventors: Masatoshi Maruyama; Yukinobu Hasegawa; Toyokichi Tange, all of Hiratsuka, Japan

[73] Assignee: Nippon Carbide Koyo Kabushiki Kaisha, Tokyo, Japan

[21] Appl. No.: 924,738

[22] Filed: Oct. 30, 1986

[30] Foreign Application Priority Data

Nov. 5, 1985 [JP] Japan ..... 60-246322

[51] Int. Cl.[4] ..... G03G 9/08

[52] U.S. Cl. ..... 430/109; 430/137; 430/111; 430/110; 430/904

[58] Field of Search ..... 430/137, 109, 110

[56] References Cited

U.S. PATENT DOCUMENTS

| | | | |
|---|---|---|---|
| 3,326,848 | 6/1967 | Clemens | 430/111 X |
| 4,105,572 | 8/1978 | Gorondy | 430/106.6 |
| 4,161,454 | 7/1979 | Lu | 430/137 |
| 4,254,201 | 3/1981 | Sawai et al. | 430/109 X |
| 4,473,628 | 9/1984 | Kasuya et al. | 430/109 |
| 4,482,621 | 11/1984 | Kashiwagi | 430/107 |

FOREIGN PATENT DOCUMENTS

| | | |
|---|---|---|
| 1119445 | 10/1978 | Canada . |
| 066395 | 5/1982 | European Pat. Off. . |
| 2007382 | 10/1977 | United Kingdom . |

*Primary Examiner*—J. David Welsh

*Attorney, Agent, or Firm*—Sherman and Shalloway

[57] ABSTRACT

A toner for developing an electrostatically charged image, comprising (A) an inner layer comprising a resin ion complex having a coloring agent and optionally a charge controlling agent and/or a magnetic material substantially dispersed therein, and (B) an outer layer containing a flowability imparting agent;

and a process for producing a toner for developing an electrostatically charged image, which comprises dispersing a coloring agent and optionally a charge controlling agent and/or a magnetic substance in a resin emulsion having a charge, mixing the dispersion with a resin emulsion having an opposite charge to prepare a dispersion of a resin ion complex, adding a flowability imparting agent to the dispersion, and spray-drying the resulting dispersion.

19 Claims, No Drawings

TONER FOR DEVELOPING ELECTROSTATIC IMAGES

This invention relates to a toner for developing an electrostatic image in electrophotography, electrostatic recording, electrostatic printing and the like.

It has generally been the practice to use heat transfer rollers heated at about 150° to 200° C. in fixing a toner image onto a receptor sheet such as paper. In recent years, attempts have been made to lower the fixing temperature and increase the fixing speed. As a result of such attempts, a toner composed of microcapsules each comprising a core portion containing a coloring substance and a shell of a resin as shown in Japanese Laid-Open Patent Publication No. 76233/1979 has attracted attention because an image developed with such a toner can be transferred and fixed by a pressure-fixing method at room temperature. The microcapsular toner has the advantage that since fixing rollers need not be heated, the waiting time at the start of the operation of the copying machine, etc. can be shortened, and the energy required for heating can be reduced. On the other hand, toners now in use are prepared generally by kneading a toner resin with a coloring agent and other additives under heat, and then finely pulverizing the mixture. The microcapsular toner has the great advantage of not requiring this finely pulverizing step for its preparation.

The application of the microcapsular toner requires a relatively high fixing pressure, and in spite of these advantages, this may lead to the defect that the fibers of the receptor sheet are destroyed or an excessive gloss is imparted to the surface of the receptor sheet. If the shell wall of the microcapsule is decreased in thickness in order to remove this defect, the shell wall of the toner is partly destroyed during toner production or during stirring for charging within the developing device, blocking occurs during storage of the toner, or the chargeability of the toner during the development is reduced.

It is an object of this invention to solve the problems of the conventional toners produced by the melt-kneading/pulverizing process or of the microcapsular toner, and to provide a toner which has excellent fixability at room temperature and lower temperatures, and good flowability conducive to the freedom from contamination of copied images or the inside of the copying machine by scattering during development, and which imparts a high resolution.

According to this invention, there is provided a toner for developing an electrostatically charged image, comprising (A) an inner layer comprising a resin ion complex having a coloring agent and optionally a charge controlling agent and/or a magnetic material substantially dispersed therein, and (B) an outer layer containing a flowability imparting agent.

The term "resin ion complex" denotes a resin particle-to-particle ionically crosslinked resin complex which results when a cationic resin emulsion and an anionic resin emulsion are mixed in such proportions that the charges of these resins are nearly neutralized.

Examples of the cationic resin constituting the resin ion complex in accordance with this invention are copolymers containing units from styrenes, alkyl (meth)acrylates and cationic chargeable functional comonomers. Those free from an anionically chargeable comonomer are suitable. Especially suitable are copolymers obtained by emulsion polymerization and having an average particle diameter of 0.05 to 1 micron, preferaly 0.07 to 0.5 micron, especially preferably 0.1 to 0.3 micron. Preferred examples are copolymers composed of (a) 90 to 20% by weight, preferably 60 to 40% by weight, of the styrenes, (b) 80 to 10% by weight, preferably 60 to 40% by weight, of the alkyl (meth)acrylates, and (c) 0.05 to 10% by weight, preferably 0.5 to 5% by weight, of the cationically chargeable functional comonomers.

The percentages are calculated based on the total weight of (a), (b) and (c). The copolymers may include units from another comonomer which can be copolymerized without impairing the properties of the toner of this invention.

Examples of the styrenes (a) include styrene, o-methylstyrene, m-methylstyrene, p-methylstyrene, alphamethylstyrene, p-ethylstyrene, 2,4-dimethylstyrene, p-n-butylstyrene, p-t-butylstyrene, p-n-hexylstyrene, p-n-octylstyrene, p-n-nonylstyrene, p-n-decylstyrene, p-n-dodecylstyrene, p-methoxystyrene, p-phenylstyrene, pchlorostyrene and 3,4-dichlorostyrene. Styrene is especially preferred.

Examples of the alkyl (meth)acrylates (b) include methyl acrylate, ethyl acrylate, n-butyl acrylate, isobutyl acrylate, propyl acrylate, n-octyl acrylate, dodecyl acrylate, lauryl acrylate, 2-ethylhexyl acrylate, stearyl acrylate, 2-chloroethyl acrylate, methyl alphachloroacrylate, methyl methacrylate, ethyl methacrylate, propyl methacrylate, n-butyl methacrylate, isobutyl methacrylate, n-octyl methacrylate, dodecyl methacrylate, lauryl methacrylate, 2-ethylhexyl methacrylate, and stearyl methacrylate. Advantageously used are (meth)acrylates of aliphatic alcohols having 1 to 12 carbon atoms, preferably 3 to 6 carbon atoms, especially preferably 4 carbon atoms.

Examples of the cationically chargeable functional comonomers are (i) (meth)acrylates of aliphatic alcohols having an amino group or a quaternary ammonium group and 1 to 12 carbon atoms, preferably 2 to 8 carbon atoms, especially preferably 2 carbon atoms, (ii) (meth)acrylamide or (meth)acrylamide mono- or di-substituted on N with an alkyl group having 1 to 18 carbon atoms, (iii) vinyl compounds substituted by a heterocyclic group having N as a ring member, and (iv) N,N-diallyl-alkylamines or quaternary ammonium salts thereof. Of these, (meth))acrylates of aliphatic alcohols having an amino group or a quaternary ammonium group are preferred as the cationically chargeable functional comonomer.

Examples of the (meth)acrylates of aliphatic alcohols having an amino or quaternary ammonium group in (i) include dimethylaminoethyl acrylate, dimethylaminoethyl methacrylate, diethylaminoethyl acrylate, diethylaminoethyl methacrylate, quaternary ammonium salts of the above four compounds, 3-dimethylaminophenyl acrylate and 2-hydroxy-3-methacryloxypropyltrimethyl ammonium salt.

Examples of the (meth)acrylamide or (meth)acrylamide mono- or di-alkyl substituted on N in (ii) include acrylamide, N-butylacrylamide, N,N-dibutylacrylamide, piperidyl acrylamide, methacrylamide, N-butylmethacrylamide, N,N-dimethylacrylamide and N-octadecylacrylamide.

Examples of the vinyl compounds substituted by a heterocyclic group having N as a ring member in (iii)

include vinylpyridine, vinylpyrrolidone, vinyl-N-methylpyridinium chloride and vinyl-N-ethyl pyridinium chloride.

Examples of the N,N-diallylalkylamine or qaternary ammonium salt thereof in (iv) are N,N-diallylmethyl ammonium chloride and N,N-diallylethyl ammonium chloride.

Examples of the anionic resin constituting the resin ion complex in accordance with this invention are copolymers comprising units from styrenes, alkyl (meth)acrylates and anionically chargeable functional comonomers. Those free from a cationically chargeable functional comonomer are preferred. Copolymers obtained by emulsion polymerization and having an average particle diameter of 0.05 to 1 micron, preferaly 0.07 to 0.5 micron, especially preferably 0.1 to 0.3 micron, are suitable. Preferred examples are copolymers composed of (a') 90 to 20% by weight, preferably 60 to 40% by weight, of the styrenes, (b') 80 to 10% by weight, preferably 60 to 40% by weight, of the alkyl (meth)acrylates, and (c') 0.05 to 10% by weight, preferably 0.5 to 5% by weight, of the anionically chargeable functional comonomers. The weight percentages of these monomers (a'), (b') and (c') are calculated based on the total weight of (a'), (b') and (c'). The copolymers may further include units from another comonomer which can be copolymerized without impairing the properties of the toner.

The styrenes in (a') are the same as the styrenes (a) in the cationic resin, and the alkyl (meth)acrylates in (b') are the same as the alkyl (meth)acrylates (b) of the cationic resin.

The anionically chargeable functional comonomers (c') maybe, for example, (i') alpha,beta-ethylenically unsaturated compounds having the group —COO and (ii') alpha,beta-ethylenically unsaturated compounds having the group —$SO_3H$.

Examples of the alpha,beta-ethylenically unsaturated compounds having the group —COO in (i') include acrylic acid, methacrylic acid, fumaric acid, maleic acid, itaconic acid, cinnamic acid, monobutyl maleate, monooctyl maleate, and metal salts (such as Na and Ca salts) of these compounds.

Examples of the alpha,beta-ethylenically unsaturated compound having the group —$SO_3H$ in (ii') are sulfonated styrene, its Na salt, allylsulfosuccinic acid, octyl allylsulfosuccinate, and its Na salt.

Further examples of the anionic resin constituting the resin ion complex in accordance with this invention include emulsifiable polyolefinic resins such as oxidized polypropylene and oxidized polyethylene, and copolymers of olefins and ethylenic vinyl monomers having an acidic group, such as an ethylene/acrylic acid copolymer and an ethylene/methacrylic acid copolymer.

The resin ion complex forming the inner layer of the toner of this invention preferably contains the cationic resin and the anionic resin in such proportions that the charges of these resins are nearly neutralized. Those resin ion complexes in which at least 70%, preferably at least 80%, more preferably at least 90%, of the charge of one of the cationic resin or the anionic resin is neutralized may also be used.

The resin ion complex has a glass transition temperature of −90° to −100° C., preferably −50° to 80° C., more preferably −10° to 60° C. and a degree of gellation, expressed as the insoluble resin content upon extraction with a Soxhlet extractor under acetone refluxing for 30 minutes, of from 0.5 to 50% by weight, preferably 5 to 30% by weight, preferably 10 to 30% by weight. If the glass transition point is too high beyond 100° C., the fixability of the toner at low temperatures tends to be reduced. If it is too low below −90° C., the flowability of the toner tends to be reduced undesirably. On the other hand, if the degree of gellation is too high beyond 50% by weight, the fixability of the toner at low temperatures tends to be reduced undesirably. If it is too low below 0.5% by weight, scattering of the toner tends to increase undesirably.

The flowability imparting agent constituting the outer layer of the toner of this invention is a hydrophobic substance selected from the group consisting of hydrophobic fluorine resins, urethane resins, polyamide resins, aromatic condensation resins, inorganic oxides, clay minerals, surface-active agents and colored dyes and pigments. The fluorine resins and hydrophobic inorganic oxides are preferred, and the fluorine resins are especially preferred.

Examples of the fluorine resins include polymers of (meth)acrylates of perfluoroalcohols having 8 to 12 carbon atoms in the alkyl moiety, vinylidene fluoride resins, vinyl fluoride resins, vinyl trifluoride resins and vinyl tetrafluoride resins.

Examples of the urethane resins are polycondensates of an alcohol component such as polyethylene glycol and polyacrylate and a polyisocyanate component such as toluene diisocyanate, hexamethylene diisocyanate and isophorone diisocyanate.

Examples of the polyamide resins are nylon 66, nylon 6, nylon 11, and copolymers of these.

Examples of the aromatic condensation resins are benzoguanamine-formaldehyde resins, phenol-formaldehyde resin, melamine-formaldehyde resin and xylene-formaldehyde resin.

Examples of the hydrophobic inorganic oxides include hydrophobic silica, alumina powder, calcium carbonate, apatites, and oxides of divalent or higher metals such as zinc, tin, iron, titanium, or manganese.

Examples of the clay minerals are mixtures of naturally occurring metal oxides such as bentonite, talc and clay.

The colored dyes and pigments may, for example, include carbon black, nigrosine dye, aniline dye, chrome yellow, ultramarine blue, methylene blue chloride, Rose Bengale, magnetite and ferrite.

Examples of the surface-active agents are silicone-type surface-active agents and fluorine-type surface-active agents.

In the toner of this invention, the outer layer of the flowability imparting agent is covered in thin layer with the outside of the inner layer composed of the resin ion complex and the coloring agent, etc. It is not necessary for the thin layer to cover the entire surface of the inner layer of the resin ion complex. It is only necessary that the thin layer covers the surface of the inner layer to such an extent as is necessary for the toner to have good flowability. The thin layer of the flowability imparting agent may be in the form of a thin film, or a layer of a powder intimately adhering to the surface or the surface layer of the inner layer.

The outer layer may be formed by using a known method. According to this invention, it may be conveniently formed by mixing two resin emulsions having opposite charges, subjecting the mixture to an aging treatment, uniformly mixing the resulting dispersion with the flowability imparting agent, and then spray-drying the mixture.

Especially preferably, the flowability imparting agent also has the ability to control positive or negative chargeability. Such a flowability imparting agent is, for example, a polymer of a perfluoroalcohol acrylate, a fluorine-containing surface-active agent, benzoguanamineformaldehyde resin, and hydrophobic silica. When the charge-controlling flowability imparting agent is used, it is not necessary to incorporate a charge controlling agent in the resin ion complex in the inner layer, and the amount of the charge controlling agent used can be drastically reduced.

The toner of this invention comprises 80 to 99.9% by weight, preferably 95 to 99.5% by weight, of the inner layer composed of the resin ion complex and the coloring agent, etc. and 20 to 0.1% by weight, preferably 5.0 to 0.5% by weight, of the outer layer of the flowability imparting agent.

The toner of the invention is preferably substantially in the form of spherical particles having a particle diameter of 1 to 30 micrometers, preferably 5 to 20 micrometers, and has a softening point of 60° to 200° C., preferably 80° to 150° C. The softening point, as used herein, denotes a temperature at which one half of a sample weighing 1 g flows in a test using a Koka-type flow tester (made by Shimazu Seisakusho) under conditions involving a load of 30 kg, a die nozzle diameter of 1 mm, a die length of 10 mm and a temperature elevation rate of 3° C./min.

The coloring agent used in this invention needs not to be special, and includes, for example, carbon black, nigrosine dye, aniline dye, chrome yellow, ultramarine blue, methylene blue chloride, Rose Bengal, magnetite and ferrite.

Examples of the charge controlling agent which can be optionally included into the inner layer of the toner of this invention are electron-donating dyes of the nigrosine type, metal salts of naphthenic acid or higher fatty acids, alkoxylated amines, quaternary ammonium salts, alkylamides, chelates, pigments and fluorine treatment activating agents for controlling positive charging; and electron-accepting organic complexes, chlorinated paraffin, chlorinated polyesters, polyesters having an excess of an acidic group, and sulfonylamine of copper phthalocyanine for controlling negative charge.

The magnetic material which may optionally be included in the inner layer of the toner of this invention may, for example, be magnetite or ferrite.

A preferred example of the process for producing the toner of this invention is as follows: The coloring agent, and optionally the charge controlling agent and/or the magnetic material are dispersed in a cationic or anionic resin emulsion, and then a resin emulsion having an opposite charge is mixed with it in an amount nearly equal to one required for neutralizing the charge of the first-mentioned resin to form a uniform dispersion of the resin ion complex. The flowability imparting agent is mixed with the dispersion. The mixture is spray-dried and as required, classified.

More preferably, after obtaining a uniform dispersion by adding the resin emulsion of an opposite charge, the pH of the dispersion is adjusted to a pH optimal for complexing, and then the dispersion is subjected to an aging treatment at 60° to 90° C., preferably 70° to 80° C. for about 0.5 to 2 hours, and then the flowability imparting agent is added.

The toner of this invention has excellent fixability at room temperature to relatively low temperatures, for example at 20° to 150° C. Since it has excellent flowability, no non-uniformity occurs in triboelectric chargeability, and scattering or fogging does not occur. It also gives an image having a high resolution.

Since the process for producing the toner of this invention does not require a melt-kneading/pulverizing step, the toner having the excellent properties as stated above can be produced at low cost.

The following examples illustrate the present invention more specifically. Unless otherwise specified, all amounts and percentages in these examples are by weight.

EXAMPLE 1

| Preparation of a cationic emulsion-polymerization resin (resin A) | |
|---|---|
| Styrene monomer (ST) | 60 parts |
| Butyl acrylate (BA) | 40 parts |
| 2-Hydroxy-3-methacryloxypropyl-trimethylammonium chloride | 5 parts |

A mixture of the above monomers was added to an aqueous solution composed of the following ingredients.

| | |
|---|---|
| Water | 150 parts |
| Nonionic emulsifier (Emulgen 950) | 1 part |
| Cationic emulsifier (Sanizol B-50) | 1.2 parts |
| Potassium persulfate | 0.5 part |

With stirring, the mixture was subjected to polymerization at 70° C. for 8 hours to give a cationic emulsion polymerization resin having a solids content of 40%.

| Preparation of an anionic emulsion-polymerization resin (resin B) | |
|---|---|
| Styrene monomer (ST) | 60 parts |
| Butyl acrylate (BA) | 40 parts |
| Methacrylic acid (MAA) | 1 part |

A mixture of the above monomers was added to an aqueous solution composed of the following ingredients.

| | |
|---|---|
| Water | 100 parts |
| Nonionic emulsifier (Emulgen 950) | 1 part |
| Anionic emulsifier (Neogen R) | 1.5 parts |
| Potassium persulfate | 0.5 part |

The mixture was subjected to polymerization with stirring at 70° C. for 8 hours to give an anionic emulsion-polymerization resin having a solids content of 50%.

| Preparation of a toner | |
|---|---|
| Resin A | 125 parts |
| Carbon black (Diablack #100) | 10 parts |
| Nigrosine dye (Bontron N-04) | 10 parts |

A mixture of the above ingredients was dispersed in a ball mill for 48 hours, and the dispersion was adjusted to pH 12 with aqueous ammonia. Subsequently, 100 parts of resin B and 500 parts of water were added, and with stirring, the mixture was maintained at 70° C. for 1 hour. By microscopic observation, it was confirmed that the resin included carbon and the nigrasine dye and grew to particles with a diameter of about 10 micrometers. Subsequently, 4 parts of hydroxyapatite (Supertite 10 made by Nihon Chemical Co., Ltd.) was added as a flowability imparting agent. The liquid dispersion was cooled, and dried by using a spray dryer (Mobile Minor, a product of Ashizawaniro Atomizer) at an inlet temperature of 120° C., an outlet temperature of 90° C. and a feed rate of 1.5 liters/min. by operating the atomizer at $3\times10^4$ r/m to obtain a test toner. The toner had a Tg of 40° C., a degree of gellation of 20%, and a softening point of 148° C. and was in the form of nearly true spherical particles with an average particle diameter of 12 micrometers. The toner showed excellent flowability.

Copying test

Four parts of the toner obtained as above was mixed with 800 parts of an iron powder (DSP-257, made by Dowa Iron Powder Industry Co., Ltd.) to prepare a developer. The mixture was set in a commercial copying machine (SF-755 made by Sharp Co.), and copying was performed. Copied images having a high density and reduced fogging were obtained. The test was carried out by varying the temperature of fixing rollers. Good fixability was obtained at temperatures of 100° C. and above.

EXAMPLES 2–10

Example 1 was repeated using the materials indicated in Table 1. The results shown in Table 1 were obtained. The abbreviations used in Table 1 were as follows:

2-EHA: 2-ethylhexyl acrylate
BD: butadiene
DMAA: dimethylaminoethyl acrylate
MBM: monobutyl maleate
VP: vinylpyridine
ASSN: sodium allylsulfosuccinate
LMA: lauryl methacrylate
DMPC: N,N-diallylmethyl ammonium chloride
IA: itaconic acid
BQA: 2-hydroxy-3-methacryloxypropyl trimethyl ammonium chloride;
BQR: benzogua
Catalytic Chemical Co., Ltd.) Alumina powder: aluminum oxide C made by Japan Aerosil Co., Ltd.
Nylon: X4001 made by Toray Inc.

In Example 10, the nylon used as a flowability imparting agent was added as a 1% isopropanol solution.

EXAMPLES 11–13

Example 1 was repeated except that the carbon black and the nigrosine dye added to the resin A in the preparation of the toner were changed to 65 parts of magnetite (BL-120, made by Titanium Industry Co., Ltd.) and 1.5 parts of a chromium-type dye (Bontron S-34, a product of Orient Chemical Co., Ltd.); and in the copying test, a copying machine (NP-201 made by Canon Co., Ltd.) was used instead of the copying machine described in Example 1. The results are shown in Table 1. The abbreviations used were as follows:

Silica: Aerosil R972 made by Japan Aerosil Co., Ltd.
Urethane: Bondic 1310F made by Dainippon Ink and Chemicals, Inc.
FR: resin obtained by copolymerizing a perfluoroacrylate (Surfron *SC-101 made by Asahi Glass Co., Ltd.)

In Example 13, FR as the flowability imparting agent was added after it was diluted with isopropanol to a solids content of 15%.

COMPARATIVE EXAMPLE 1

Example 11 was repeated except that the flowability imparting agent was not added. The resulting toner had no significant flowability, and the copying test was impossible.

Method of evaluating flowability

Twenty grams of the toner was put in a plastic bottle and left to stand in a constant-temperature chamber at 50° C. for 9 hours. The degree of agglomeration of the toner was then measured by a powder tester (made by Hosokawa Micron Co., Ltd.), and used as a measure of flowability. By using a #42-mesh sieve, the test was conducted by vibration channel 4 for 30 seconds, and then the weight of the toner remaining on the sieve was measured, and evaluated on the following scale.

A: less than 0.5 g
B: 0.5 to 1 g
C: 1 to 5 g
D: more than 5 g
E: all the toner agglomerated firmly in the plastic bottle.

TABLE

| | Cationic resin (A) | | | Anionic resin (B) | | | Tg of the | Degree of gel- | Soft- ening | Flowability | Lowest fixing temper- | |
|---|---|---|---|---|---|---|---|---|---|---|---|---|
| Example | ST | (Meth)- acrylate | Cationic monomer | ST | (Meth)- acrylate | Anionic monomer | toner (°C.) | lation (%) | point (°C.) | imparting agent | ature (°C.) | Flow- ability |
| 1 | 60 | BA 40 | BQA 5 | 60 | BA 40 | MAA 1 | 40 | 20 | 148 | Supertite 10 (4) | 100 | A |
| 2 | 40 | BA 70 | BQA 5 | 40 | BA 60 | MAA 1 | 15 | 25 | 95 | Supertite 10 (4) | 80 | B |
| 3 | 40 | 2-EHA 60 | BQA 5 | 40 | 2-EHA 60 | MAA 1 | 7 | 30 | 87 | Supertite 10 (4) | 70 | B |
| 4 | 40 | BD 60 | BQA 5 | 40 | BD 60 | MAA 1 | −10 | 50 | 130 | Supertite 10 (4) | 90 | C |
| 5 | 40 | 2-EHA 60 | DMAA 1 | 40 | 2-EHA 60 | MBM 1 | 2 | 5 | 85 | Supertite 10 (4) | 60 | B |
| 6 | 40 | 2-EHA 60 | VP 0.5 | 40 | 2-EHA 60 | ASSN 0.5 | 5 | 7 | 80 | Supertite 10 (4) | 60 | B |
| 7 | 20 | LMA 80 | DMPC 2 | 20 | LMA 80 | IA 5 | −48 | 35 | 65 | Supertite 10 (4) | 30 | D |
| 8 | 40 | 2-EHA 60 | BQA 5 | 40 | 2-EHA 60 | MAA 1 | 10 | 30 | 90 | BGR (5) | 60 | A |
| 9 | 40 | 2-EHA 60 | BQA 5 | 40 | 2-EHA 60 | MAA 1 | 8 | 30 | 85 | Alumina powder | 70 | B |

TABLE-continued

| Example | Cationic resin (A) ST | (Meth)-acrylate | Cationic monomer | Anionic resin (B) ST | (Meth)-acrylate | Anionic monomer | Tg of the toner (°C.) | Degree of gel-lation (%) | Soft-ening point (°C.) | Flowability imparting agent | Lowest fixing temper-ature (°C.) | Flow-ability |
|---|---|---|---|---|---|---|---|---|---|---|---|---|
| 10 | 90 | 2-EHA 10 | BQA 5 | 20 | LMA 80 | MAA 1 | 20 | 35 | 105 | (2) Nylon | 70 | A |
| 11 | 40 | 2-EHA 60 | BQA 5 | 40 | 2-EHA 60 | MAA 1 | 18 | 30 | 92 | (5) Silica | 90 | A |
| 12 | 40 | 2-EHA 60 | BQA 5 | 40 | 2-EHA 60 | MAA 1 | 65 | 45 | 110 | (1.5) Urethane | 100 | A |
| 13 | 40 | 2-EHA 60 | BQA 5 | 40 | 2-EHA 60 | MAA 1 | 5 | 30 | 85 | (15) FR | 60 | B |
| Compara-tive Example 1 | 40 | 2-EHA 60 | BQA 5 | 40 | 2-EHA 60 | MAA 1 | 18 | 30 | 92 | (2) None | Test impos-sible | B |

EXAMPLE 14

Fourty-six parts of oxidized propylene wax emulsion resin (Hitec E-433N, a product of Toyo Chemical Co., Ltd.), 40 parts of magnetite (Mapico BL-220, a product of Titanium Industry Co., Ltd.), 1 part of a nigrosine dye (Bontron N-04, a product of Orient Chemical Co., Ltd.) and 400 parts of water were dispersed for 1.5 hours by a disper to give an anionic resin emulsion.

The dispersion was transferred to a glass flask equipped with a stirring device, and heated to 70° C. Then, 11 parts of the cationic emulsion-polymerization resin (resin B) prepared in Example 1 was added, and the mixture was stirred for 2 hours. After confirming that the particle diameter grew to about 10 micrometers, the temperature was lowered to 50° C. to give a resin ion complex.

Two parts of hydroxyapatite (Supertite 10, a product of Nippon Chemical Co., Ltd.) was added as a flowability imparting agent, and the mixture was dried under the same conditions as in Example 1 to prepare a test toner. The toner had a Tg of −25° C., a degree of gellation of 15% and a softening point of 110° C. and was nearly in the form of spherical particles having an average particle diameter of 10 micrometers.

The toner was subjected to the same copying test as in Example 1 except that the copying machine was changed to a copying machine PC-30 of Canon Co., Ltd. adapted for pressure fixation of toners. The lowest temperature at which fixation was possible was −10° C., and the toner had a flowability of C. Images having a high density and excellent clarity were obtained. The images were not contaminated even by rubbing it with a finger. The fixed images were not peeled even when bent.

What is claimed is:

1. A toner for developing an electrostatically charged image, comprising (A) an inner layer comprising a resin ion complex comprising a resin particle-to-particle ionically crosslinked resin complex having a coloring agent and optionally a charge controlling agent and/or a magnetic material substantially dispersed therein, and (B) an outer layer containing a flowability imparting agent.

2. The toner of claim 1 wherein the resin ion complex has a Tg of −90° to 100° C.

3. The toner of claim 1 wherein the resion ion complex has a degree of gellation of 0.5 to 50%.

4. The toner of claim 1 wherein the flowability imparting agent is a hydrophobic flowability imparting agent selected from the group consisting of hydrophobic fluorine-type resins, urethane resins, polyamide resins, aromatic condensation resins, hydrophobic inorganic oxides, clay minerals, colored dyes and pigments and surface-active agents.

5. The toner of claim 1 wherein the flowability imparting agent has the ability of control positive or negative chargeability and is a polymer of perfluoroalcohol acrylate, a fluorine-containing surface active agent, benzoguanamine-formaldehyde resin, or hydrophobic silica.

6. The toner of claim 1 which comprises 80 to 99.9% by weight of the inner layer and 20 and 20 to 0 1% by weight of the outer layer.

7. The toner of claim 1 which is substantially in the form of spherical particles having a particle diameter of 1 to 30 micrometers.

8. The toner of claim 1 which has a softening point of 60° to 200° C.

9. A process for producing a toner for developing an electrostatically charged image, which comprises dispersing a coloring agent and agent and optionally a charge controlling agent and/or magnetic substance in a resin emulsion having a charge, mixing the dispersion with a resin emulsion having an opposite charge to prepare a dispersion of a resin ion complex, aging the resulting dispersion, adding a flowability imparting agent to the dispersion, and spray-drying the resulting dispersion.

10. The process of claim 9 wherein after adding the resin emulsion having an opposite charge, the dispersion is subjected to an aging treatment at 60° to 90° C.

11. The process of claim 10 wherein the aging time is 0.5 to 2 hours.

12. The toner of claim 1 wherein the resin particle-to-particle ionically cross linked resin complex is obtained by mixing an emulsion of a cationic resin and an anionic resin in such proportions that the charges of these resins are nearly neutralized.

13. The toner of claim 12 wherein the cationic resin is a copolymer composed of (a) 90 to 20% by weight of styrene monomer, (b) 80 to 10% by weight of acrylacrylate or alkyl (meth)acrylate monomer, and (c) 0.05 to 10% by weight of cationically chargeable functional comonomer; and the anionic resin is a copolymer composed of (a') 90 to 20% by weight of styrene monomer, (b') 80 to 10% by weight of alkylacrylate or alkyl (meth) acrylate monomer, and (c') 0 0.05 to 10% by weight of anionically chargeable functional comonomer.

14. The toner of claim 13 wherein the copolymer of the cationic resin emulsion and the copolymer of the anionic resin emulsion each have average particle diameter of from 0.05 to 1 micron.

15. The toner of claim 1 wherein the resin ion complex has a Tg of −50° C. to 80° C. and a degree of gellation of 5 to 30% by weight.

16. The toner of claim 1 which comprises 95 to 99.5% by weight of the inner layer and 5.0 to 0.5% by weight of the outer layer.

17. The toner of claim 1 wherein the inner layer comprises the resin ion complex, coloring agent and charge controlling agent.

18. The toner of claim 1 wherein the inner layer comprises the resin ion complex, coloring agent and magnetic material.

19. The toner of claim 1 wherein the inner layer comprises the resin ion complex, coloring agent, charge controlling agent and magnetic material.

* * * * *

UNITED STATES PATENT AND TRADEMARK OFFICE

CERTIFICATE OF CORRECTION

PATENT NO. : 4,797,339

DATED : January 10, 1989

INVENTOR(S) : MASATOSHI MARUYAMA ET AL.

It is certified that error appears in the above-identified patent and that said Letters Patent is hereby corrected as shown below:

Claim 3, line 1 of the claim, "resion" should read --resin--.

Claim 5, line 2 of the claim, "of" should read --to--.

Claim 6, line 2 of the claim, "and 20" (second occurrence) should be deleted and "0 1%" should read --0.1%--.

Claim 9, line 3 of the claim "and agent" should be deleted.

Claim 13, line 12 of the claim, "00.05" should read --0.05--.

Signed and Sealed this

Second Day of May, 1989

*Attest:*

*Attesting Officer*

DONALD J. QUIGG

*Commissioner of Patents and Trademarks*